US008227992B2

(12) United States Patent
Kaening et al.

(10) Patent No.: US 8,227,992 B2
(45) Date of Patent: Jul. 24, 2012

(54) HIGH-PRESSURE DISCHARGE LAMP

(75) Inventors: Marko Kaening, Munich (DE); Bernhard Schalk, Eching (DE); Steffen Franke, Greifswald (DE); Ralf-Peter Methling, Greifswald (DE)

(73) Assignee: Osram AG, Munich (DE)

( * ) Notice: Subject to any disclaimer, the term of this patent is extended or adjusted under 35 U.S.C. 154(b) by 321 days.

(21) Appl. No.: 12/669,050

(22) PCT Filed: Jul. 16, 2007

(86) PCT No.: PCT/EP2007/057299

§ 371 (c)(1),
(2), (4) Date: Jan. 14, 2010

(87) PCT Pub. No.: WO2009/010088

PCT Pub. Date: Jan. 22, 2009

(65) Prior Publication Data

US 2010/0213867 A1 Aug. 26, 2010

(51) Int. Cl.
*H01J 17/20* (2012.01)

(52) U.S. Cl. ..... 313/640; 313/637; 313/630; 313/39; 315/209 R; 315/291; 315/246

(58) Field of Classification Search ..... 313/25, 313/39, 493, 571, 574, 630, 631, 637, 640; 315/209 R, 246, 244, 289, 291
See application file for complete search history.

(56) References Cited

U.S. PATENT DOCUMENTS 3,897,594 A 7/1975 Popp et al.
4,015,164 A * 3/1977 Fischer et al. ..... 313/642
4,801,846 A * 1/1989 Kramer et al. ..... 313/641
5,239,232 A * 8/1993 Heider et al. ..... 313/639
6,353,289 B1 * 3/2002 Ishigami et al. ..... 313/637
6,469,444 B1 * 10/2002 Leng et al. ..... 313/637
6,833,677 B2 * 12/2004 Jackson et al. ..... 313/642
7,323,820 B2 * 1/2008 Jungst et al. ..... 313/638
7,432,658 B2 10/2008 Derhaeg (Continued)

FOREIGN PATENT DOCUMENTS

DE 2317461 A1 10/1974

(Continued)

OTHER PUBLICATIONS

CIE (International Commission on Illumination), Technical Report: Method of Measuring and Specifying Colour Rendering Properties of Light Sources, ISBN 3900734877, CIE 13.3-1995.

(Continued)

*Primary Examiner* — Haiss Philogene

(57) ABSTRACT

A high-pressure discharge lamp may include a discharge vessel, which contains: electrodes, at least one noble gas as a start gas, at least one element selected from the group consisting of Al, In, Mg, Tl, Hg, and Zn for arc transfer and discharge vessel wall heating, and at least one rare earth halide for the generation of radiation, which is configured such that the generated light is dominated by molecular radiation, wherein at least one member of a first group of rare earth halides is used together with at least one member of a second group of rare earth halides, the first group having the property that the color distance decreases with a power increase when the power of the lamp is increased in a predetermined power interval, and the second group having the property that the color distance increases with a power increase when the power of the lamp is increased in this predetermined power interval.

16 Claims, 13 Drawing Sheets

U.S. PATENT DOCUMENTS

2009/0302784 A1 12/2009 Franke et al.

FOREIGN PATENT DOCUMENTS

| | | | |
|---|---|---|---|
| DE | 10307067 | B3 | 8/2004 |
| DE | 102006034833 | A1 | 1/2008 |
| EP | 0785702 | B1 | 11/2001 |
| EP | 0714118 | B1 | 7/2002 |
| EP | 0883160 | B1 | 12/2005 |
| JP | 2006318731 | A | 11/2006 |
| WO | 9825294 | A1 | 6/1998 |
| WO | 9905699 | A1 | 2/1999 |

OTHER PUBLICATIONS

M. Born, Physics of mercury-free high-pressure discharge lamps, Institute of Physics Publishing, Plasma Sources Science and Technology 11, Aug. 19, 2002, IOP Publishing Ltd., A55-A63 (online at stacks.iop.org/PSST/11/A55).

International Search Report dated May 7, 2008.

English language abstract of JP 2006318731 A.

* cited by examiner

HIGH-PRESSURE DISCHARGE LAMP

RELATED APPLICATIONS

The present application is a national stage entry according to 35 U.S.C. §371 of PCT application No.: PCT/EP2007/057299 filed on Jul. 16, 2007.

TECHNICAL FIELD

Various embodiments relate to a high-pressure discharge lamp.

BACKGROUND

High-pressure discharge lamps, in particular so-called HID lamps, have been known for a long time. They are used for various purposes, and above all for applications in which relatively good color rendering and very good luminous efficiency are required. These two properties are usually in conflict, i.e. improving one property degrades the other, and vice versa. The color rendering is generally more important for general lighting applications, but the situation is reversed for example in street lighting.

High-pressure discharge lamps are furthermore distinguished by a high power in relation to the size of the lamp or the size of the light-emitting region.

Here and in what follows, high-pressure discharge lamps are intended to mean only those lamps which have electrodes inside the discharge vessel. There are very many publications and an enormous amount of patent literature on the subject of high-pressure discharge lamps, for example WO 99/05699, WO 98/25294, and Born, M., Plasma Sources Sci. Technol., 11, 2002, A55.

DE Application 10 2006 034 833.8, which has not yet been published, discloses a molecular radiation-dominated high-pressure discharge lamp. With noncritical selection of the rare earth iodides, however, the problem of a sensitive power dependency of the color distance $\Delta C(P)$ in the event of a power variation often arises. The color distance is also referred to as the color difference or color deviation. Minor differences in the power from the working point with $\Delta C=0$ lead to sizable $\Delta C$ values, which change very rapidly with an increasing power from positive to negative values or vice versa.

SUMMARY

Various embodiments provide a molecular radiation-dominated high-pressure discharge lamp, which is distinguished by good color rendering over a large power range. Various embodiments also achieve a maximally high efficiency of such a lamp.

Various embodiments provide a high-pressure discharge lamp which is improved in respect of a good overall combination of luminous efficiency and color-rendering properties, and which is distinguished in particular by high consistency of the color rendering and by a small color deviation over a large power range. It has been found that this can expediently be achieved by combining at least two groups of rare earths as a constituent of the filling, the first group having the property that the color distance decreases with a power increase when the power of the lamp is increased in a predetermined power interval, and the second group having the property that the color distance increases with a power increase when the power of the lamp is increased in this predetermined power interval, so that a suitable combination of members of the two groups leads to a flat profile close to zero of the color distance with a power increase. The change in the power may be regarded on the one hand from the perspective of dimmability, and on the other hand from the aspect of variation of the power in a sizeable assembly of lamps and their variance of properties.

Various embodiments provide a high-pressure discharge lamp having a discharge vessel, which contains: electrodes, at least one noble gas as a start gas, at least one element selected from the group consisting of Al, In, Mg, Tl, Hg, Zn for arc transfer and discharge vessel wall heating, and at least one rare earth halide for the generation of radiation, which is configured such that the generated light is dominated by molecular radiation.

Various embodiments provide a lighting system consisting of the high-pressure discharge lamp together with a suitable electronic ballast device for operating it.

The basic concept of the invention, as explained in DE Application 10 2006 034 833.8, is to utilize the radiation generated by molecules in the discharge medium very dominantly for the generation of light by the high-pressure discharge lamp. To this end the rare earth halide is provided for the generation of radiation, although other constituents of the discharge plasma may naturally also be involved in the generation of radiation.

Conventional high-pressure discharge lamps are dominated by atomic radiation. Molecular radiation conventionally occurs secondarily and has a broader-band spectral distribution compared with atomic radiation, and can thus entirely fill wider wavelength segments with radiation. In contrast to this, atomic radiation is inherently line radiation, although some broadening of the basically restricted color rendering properties of line radiation has been achieved in conventional lamps by a multiplicity of lines and various broadening mechanisms. Generally, however, the segments generated by such mechanisms are much smaller than in molecular radiation and the linewidths of atoms are closely correlated with other particle densities in a complicated way, and it is very difficult to influence particle densities in the lamp.

Here, promoting molecules in the radiation balance of the lamp also has the effect of allowing good absorption properties and therefore stronger thermalization. The term thermalization is in this case to be understood locally. The concept of local thermodynamic equilibrium is used, because naturally there is not in fact a homogeneous temperature distribution.

The lamp includes a noble gas or noble gas mixture as a start or a buffer gas, the noble gases Xe, Ar, Kr being preferred, and among these more particularly Xe. Typical cold fill partial pressures of the start gas lie in the range of from 10 mbar to 15 bar and preferably between 50 mbar and 10 bar, more preferably between 500 mbar and 5 bar and more particularly preferably between 500 mbar and 2 bar. An arc transfer and vessel wall heating component is furthermore provided, which includes at least one element selected from the group consisting of Al, In, Mg, Tl, Hg, Zn. These elements may be present as halides, in particular iodides or bromides, and the lamp may also be filled with them in this form, for instance as $AlI_3$ or TlI. The start or buffer gas ensures cold startability and cold ignition of the discharge. Sufficient heating leads to evaporation of the arc transfer and vessel wall heating elements present in a chemical compound, or in the case of Al, Mg, In, Hg and Zn possibly also an elementary form. The corresponding chemical components in the resulting plasma carry the arc. The wall temperature increases owing to the modified plasma properties, so that the at least one rare earth halide also enters the vapor phase. This rare earth halide is preferably formed with an element from the group consisting of Tm, Dy, Ce, Ho, Gd, preferably from the group consisting of Tm, Dy, and more particularly preferably Tm. Here, as above, iodides or bromides are preferred. One example is $TmI_3$. The components important for the start process, i.e. the start gas and the arc transfer and vessel wall heating elements, may now possibly play only a secondary role in the emission.

In contrast to conventional high-pressure discharge lamps, an arc is now created which is dominated by the molecular emission, in particular by the rare earth halides. Thulium iodide TmI may in particular be envisaged, since this is formed from the triiodide $TmI_3$ with which the lamp is filled.

In principle, the lamp may in particular be filled with rare earth elements as triiodides, which become diiodides and finally monoiodides as a function of the temperature. Temporarily formed rare earth monoiodides, or in general monohalides, are particularly effective for the invention.

The role of the rare earth halides is not limited to generating the desired continuous radiation. They are also used for arc contraction, i.e. to reduce the temperature in the contraction regions and correspondingly change the ohmic impedance of the plasma.

In conventional high-pressure discharge lamps, distinction is traditionally made between so-called voltage gradient generators and light generators. The addition of a special voltage gradient generator is not categorically necessary in the present context and may even be counterproductive, at least beyond certain amounts. Owing to the special design of the temperature profile in the form of the contracted arc, species contained in the discharge core in any event clearly provide suitable formation of the plasma impedance. In particular, the classical voltage gradient generators Hg and Zn may be entirely or partially obviated, although the invention is not restricted to Hg- and Zn-free lamps. Merely the possibility of omitting or at least reducing the constituent Hg offers a significant advantage in environmental terms.

The constituents Hg and Zn may however also play a positive role for example in connection with wall interactions, or may even be desirable in order to increase the lamp voltage further, and the lamp may therefore contain a voltage gradient generator despite the option of obviating them per se.

In order to achieve very good radiation efficiencies, it has conventionally been usual to employ atomic radiation, and in particular that of Tl and Na. Not only is the use of atomic radiation in order to achieve high luminous efficiencies no longer necessary in the present context, but it is not even desirable owing to the color rendering properties, and in the case of Tl and Na above all owing to undesirable arc cooling. In particular, the introduction of Na should be entirely avoided or significantly restricted. The Na radiation in the infrared range at about 819 nm and other infrared lines of Na can leave the plasma substantially unimpeded because it is often optically very thin above a threshold wavelength, for instance above about 630 nm, and can cool the arc. Even though the spectral range around the Na resonance line at 589 nm cannot be regarded as optically thin, this radiation would also lead to undesirable cooling of the central arc regions. The temperatures in the arc would therefore be reduced undesirably. A similar argument also applies for other species which have significant emissivities in the wavelength range of more than 580 nm, in particular K and Ca. The constituents Na, K and Ca should thus preferably be present at most in amounts which are not relevant for the emission properties and do not interfere with said domination by molecular radiation.

According to the invention, the plasma should be optically thick over a visible spectral range which is as wide as possible. This means that there is more substantial thermalization of the radiation before it emerges from the lamp, in comparison with conventional high-pressure discharge lamps, which creates a desirable approximation of a Planck-like spectral distribution. The Planckian radiation distribution corresponds to the idealized black-body radiator, and is interpreted as "natural" in human sensory perception.

Moreover, the pronounced radiation contributions of the additives Na, K and Ca "bend" the spectra and degrade the approximation to Planckian spectral behavior. Lines at wavelengths of more than 600 nm, however, can in principle scarcely be avoided because the rare earth halides no longer absorb significantly here and no other absorbers are available.

The approximation to Planckian spectral behavior can be measured by the so-called color difference $\Delta C$. The lamp according to the invention should have a good, i.e. small $\Delta C$ value. When using ceramic discharge vessels, values of $|\Delta C|<10^{-2}$ can very advantageously be achieved here for general lighting purposes.

Good luminous efficiencies can be achieved with the high-pressure discharge lamp according to the invention, and to be specific preferably more than 90 lm/W. The color rendering properties should at the same time be very good, preferably with a color rendering index Ra of at least 90.

In particular cases, however, one of the two aims mentioned above, i.e. the color rendering properties or the luminous efficiency, may more particularly be of greater importance for the embodiment of the invention, for instance the luminous efficiency in the case of street lighting. The preferred field of application of the invention is however high-quality general lighting, for which both values are in the end important.

In one configuration, the domination by molecular radiation is quantified by a parameter AL, which is referred to here as the "atomic line component". Claim 13 gives a definition of this atomic line component AL. It is preferably at most 40%, more preferably 35%, 30% or even at most 25%, even in the case of quartz discharge vessels. For ceramic discharge vessels, it is particularly preferably at most 20%, more preferably 15% and even at most 10%.

The particular stability when there is a variation in the power is achieved by suitably combining a plurality of rare earth halides as molecular radiators. In this context, two groups of rare earth halides are used together. A first group has the property that minor differences in the power from the working point with $\Delta C=0$ lead to sizable $\Delta C$ values, which change rapidly with an increasing power from positive to negative values. One particularly suitable member of this group is Tm halide, in particular $TmI_3$. A second group has the property that minor differences in the power from the working point with $\Delta C=0$ lead to sizable $\Delta C$ values, which change rapidly with an increasing power from negative to positive values. One particularly suitable member of this group is Dy halide, in particular $DyI_3$. Another highly suitable member of this group is $GdI_3$, which may in particular be used in addition to Dy halide. A mixture which contains approximately equal molar amounts of the first and second groups, in particular from 25 to 75 mol % of the first group, is particularly highly suitable. A proportion of from 45 to 55 mol % is particularly preferred for the first group.

The favorable properties of a lamp according to the invention may above all be exploited and optimized in conjunction with an electronic ballast device, for which reason the invention also relates to a lighting system consisting of a lamp according to the invention with a suitable electronic ballast device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
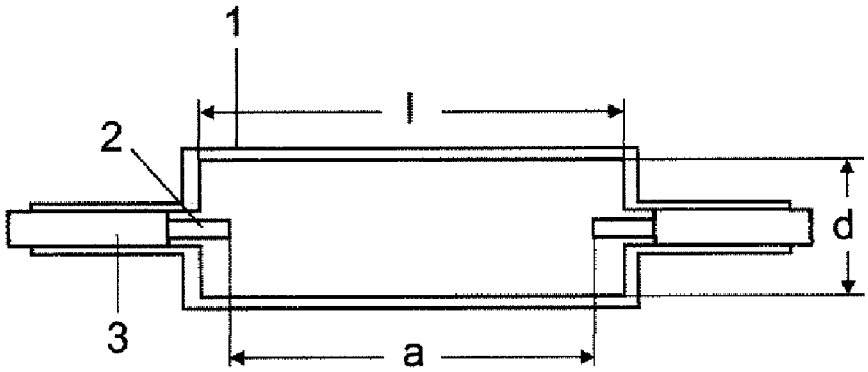
FIG. 1 shows a schematic sectional representation of a high-pressure discharge lamp according to the invention having a ceramic discharge vessel.
Figure 2:
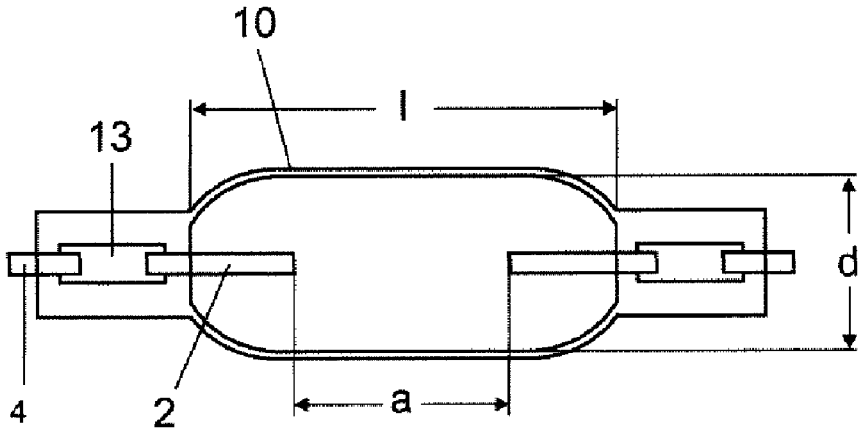
FIG. 2 shows a schematic sectional representation of a high-pressure discharge lamp according to the invention having a quartz glass discharge vessel.

FIG. 1 and FIG. 2 show schematic sectional views of high-pressure discharge lamps according to the invention. FIG. 1 shows a lamp having a discharge vessel 1 made of $Al_2O_3$ ceramic. The flow of current through the arc discharge is made possible by tungsten electrodes 2, which are applied on both sides in the discharge vessel and introduced into the discharge vessel via a feed-through system 3. The feed-through system consists for example of molybdenum pins, and is welded to the electrode and to the outer electrical lead (not shown in the figure).

FIG. 2 shows a lamp having a discharge vessel 10 made of quartz glass. Here, the tungsten electrodes 2 are welded to a molybdenum foil 13. In the region of this foil, the quartz glass discharge vessel is sealed by a pinch. The molybdenum foils are also welded to the respective outer electrical lead 4.

The characteristic dimensions of the discharge vessel are the length l, the internal diameter d and the electrode spacing a, which will be discussed in more detail below.

Figure 3:
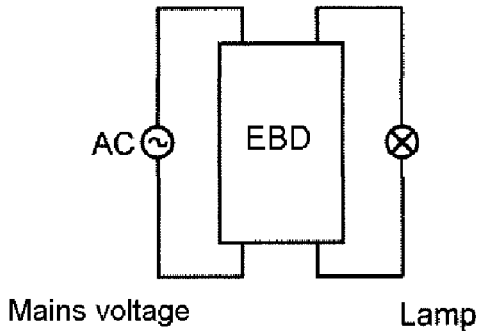
FIG. 3 shows a circuit diagram with an electronic ballast device and a lamp according to FIGS. 1 and 2.

Both the ceramic discharge vessel and the quartz glass discharge vessel are respectively fitted in an outer bulb (not shown) made of quartz glass, as is known per se. The outer bulb is evacuated. The electrical leads are fed out from the outer bulb through pinches which seal the outer bulb in a leaktight fashion, and are used for connecting the lamp to the electronic ballast device (EBD). From the mains voltage, the latter generates the square-wave excitation typically used for operating high-pressure discharge lamps, with a frequency of typically from 100 Hz to 400 Hz at a power of from 35 W to 400 W ("alternating DC voltage"). FIG. 3 shows a basic circuit diagram with the mains voltage abbreviated to AC, the electronic ballast device abbreviated to EBD and the lamp.

The discharge vessel contains a filling with Xe as a start gas and $AlI_3$ and TlI as arc transfer and wall heating elements, as well as $TmI_3$.

The fill quantities and the characteristic dimensions of the discharge vessel vary according to the embodiment of the lamp.

Typical examples A1 to A6 are given in Table 1. The Xe pressure indicated is the cold fill pressure. The iodide quantities indicated are the absolute amounts added. The aforementioned geometrical parameters l, d, a are also indicated. The ΔC data are given in thousandths (E-3).

The electronic ballast device may preferably be designed to excite acoustic resonances, by imposing a radiofrequency amplitude modulation in a frequency range of for instance between 20 and 60 kHz. For more detailed explanation, reference is made for example to the Patent EP-B 0 785 702 and the references given therein. Excitation of acoustic resonances in this form leads to active stabilization of the discharge arc in the plasma, which can in particular also be advantageous in connection with the present invention owing to the relatively constricted shape of the temperature profile.

TABLE 1

| | Material of the discharge vessel | Length l | Diameter d | Electrode spacing a | Filling | Atomic line component AL | ΔC | Power P | Power per unit area of wall |
|---|---|---|---|---|---|---|---|---|---|
| A1 | ceramic | 22 | 6 | 19 | 1 bar Xe, 2.2 mg $AlI_3$, 0.5 mg TlI, 3.9 mg $TmI_3$ | 4% | 0.3E−3 | 180 W | 43 W/cm$^2$ |
| A2 | Ceramic | 13 | 9 | 10 | 1 bar Xe, 2 mg $AlI_3$, 0.5 mg TlI, 16 mg $TmI_3$ | 4% | −0.2E−3 | 150 W | 41 W/cm$^2$ |
| A3 | Quartz | 24 | 8 | 18 | 1 bar Xe, 2 mg $AlI_3$, 0.5 mg TlI, 1.1 mg $TmI_3$ | 12% | 24E−3 | 150 W | 25 W/cm$^2$ |
| A4 | Ceramic | 13 | 9 | 10 | 1 bar Xe, 2.2 mg $AlI_3$, 0.5 mg TlI, 4 mg $DyI_3$ | 13% | −0.1E−3 | 200 W | 55 W/cm$^2$ |
| A5 | Ceramic | 13 | 9 | 10 | 1 bar Xe, 2 mg $AlI_3$, 8 mg $DyI_3$, 8 mg $CeI_3$ | 10% | 7E−3 | 150 W | 41 W/cm$^2$ |

TABLE 1-continued

| | Material of the discharge vessel | Length l | Diameter d | Electrode spacing a | Filling | Atomic line component AL | ΔC | Power P | Power per unit area of wall |
|---|---|---|---|---|---|---|---|---|---|
| A6 | Ceramic | 13 | 9 | 10 | 1 bar Xe, 2.2 mg $AlI_3$, 0.5 mg TlI, 4 mg $CeI_3$ | 16% | 21E−3 | 324 W | 89 W/cm$^2$ |

The last four columns in Table 1 will be discussed in more detail below.

Figure 4:
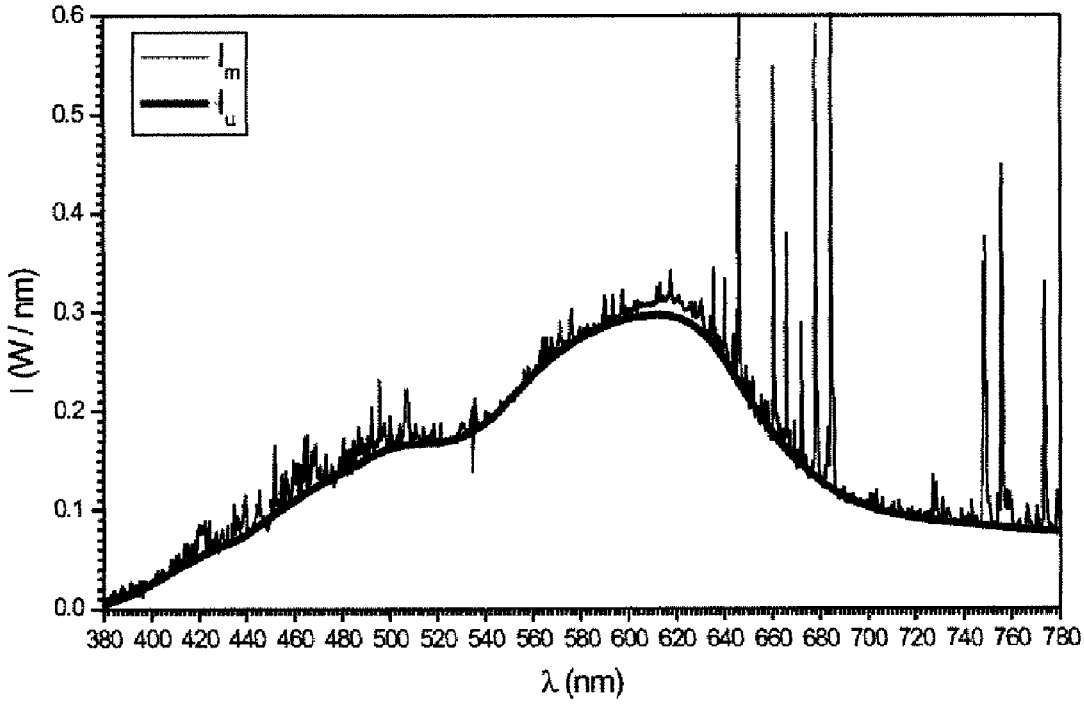
FIGS. 4-6 show emission spectra of the lamps in FIGS. 1 and 2.
Figure 5:
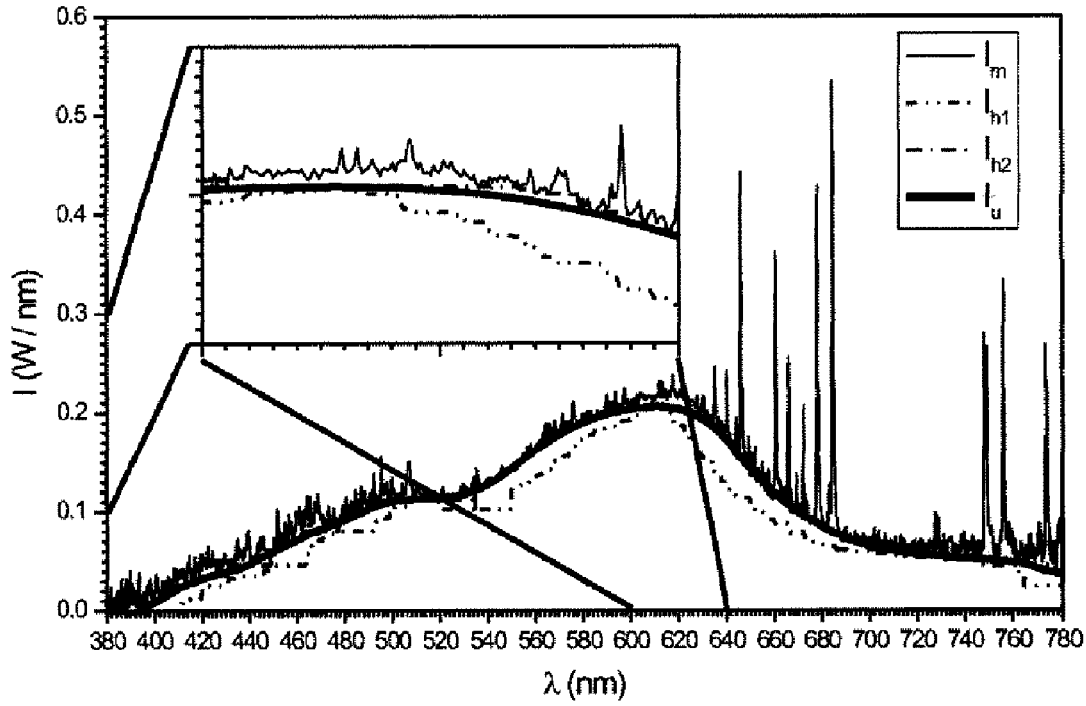
Figure 6:
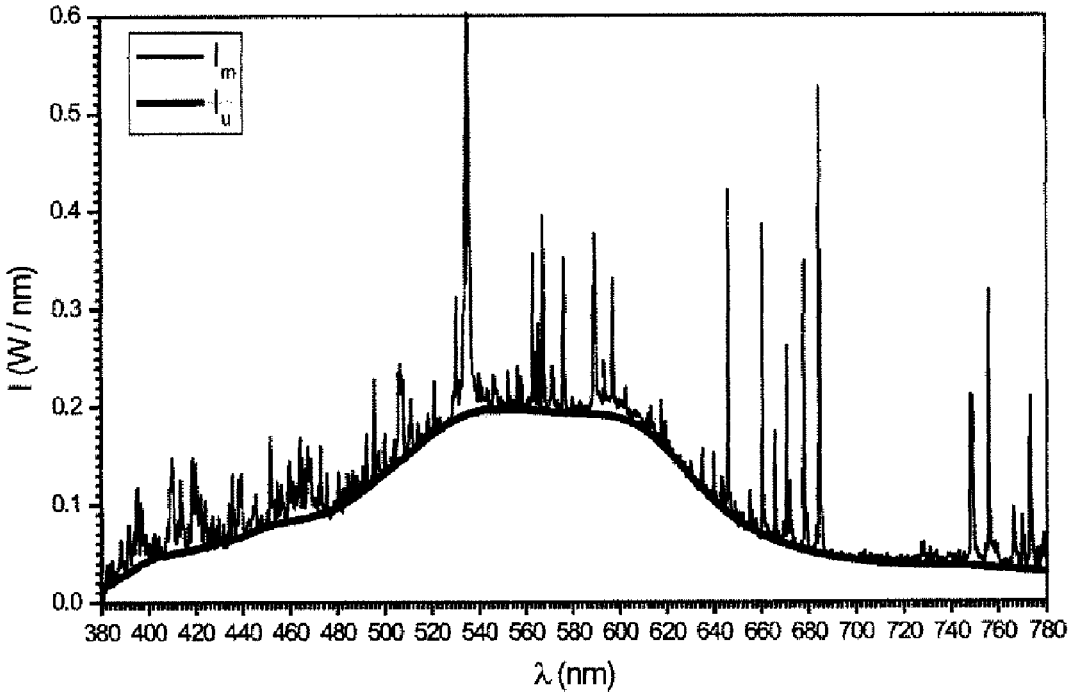

First, emission spectrum of the lamps will be presented for exemplary embodiments A1, A2 and A3. The way in which the atomic line component AL is determined will also be explained. FIGS. 4, 5 and 6 respectively relate to exemplary embodiments A1, A2 and A3, and they each show a spectrum of the emission of the lamps in FIG. 1 or FIG. 2 in the visible range between 380 nm and 780 nm, as measured with a spectral resolution of 0.3 nm after 10 h of operation in an Ulbricht sphere. The vertical axis shows the spectral power density I in mW/nm.

Superimposed on the serrated line which can be seen, corresponding to the resolution, there is in each case a curve for determining the continuous background, which is determined according to the following method. In particular, reference is made in this regard to the additional graphical explanations in FIG. 5. The measurement provides a curve $I_m(\lambda)$. In an interval with total width of 30 nm around each wavelength value λ corresponding to a measurement, i.e. with 50 measurement values on each side, a minimum $I_{h1}(\lambda)$ in this interval is assigned to each wavelength value. This gives a smoothed function $I_{h1}(\lambda)$ essentially extending below the measured spectral distribution $I_m(\lambda)$.

A further function $I_{h2}(\lambda)$ is determined on the basis of this, intervals with the same width in turn being used around each individual wavelength value, i.e. with a total of 100 measurement points. In this case, however, the maxima of the function $I_{h1}(\lambda)$ in these intervals are respectively used as function values $I_{h2}$. This creates a second function which lies somewhat closer to the measured profile, i.e. it extends between the measured profile $I_m(\lambda)$ and the function $I_{h1}(\lambda)$ with the minima.

A third function $I_u(\lambda)$ is determined on the basis of this, this time the average values of $I_{h2}(\lambda)$ being determined again in the 30 nm width intervals around the respective wavelength values. This smooths the curve $I_{h2}$ considerably and leads in this example to the smooth lines indicated in FIGS. 4 to 6.

Essentially, this is only a relatively simple model procedure for determining a realistic continuous background, although it is objective and reproducible. With the background function $I_u(\lambda)$ which has been found and the spectral distribution $I_m(\lambda)$ which has been measured, the atomic line component AL can then be determined as:

$$AL = \frac{\int_0^\infty V(\lambda) I_m(\lambda)\, d\lambda - \int_0^\infty V(\lambda) I_u(\lambda)\, d\lambda}{\int_0^\infty V(\lambda) I_m(\lambda)\, d\lambda}$$

Figure 7:
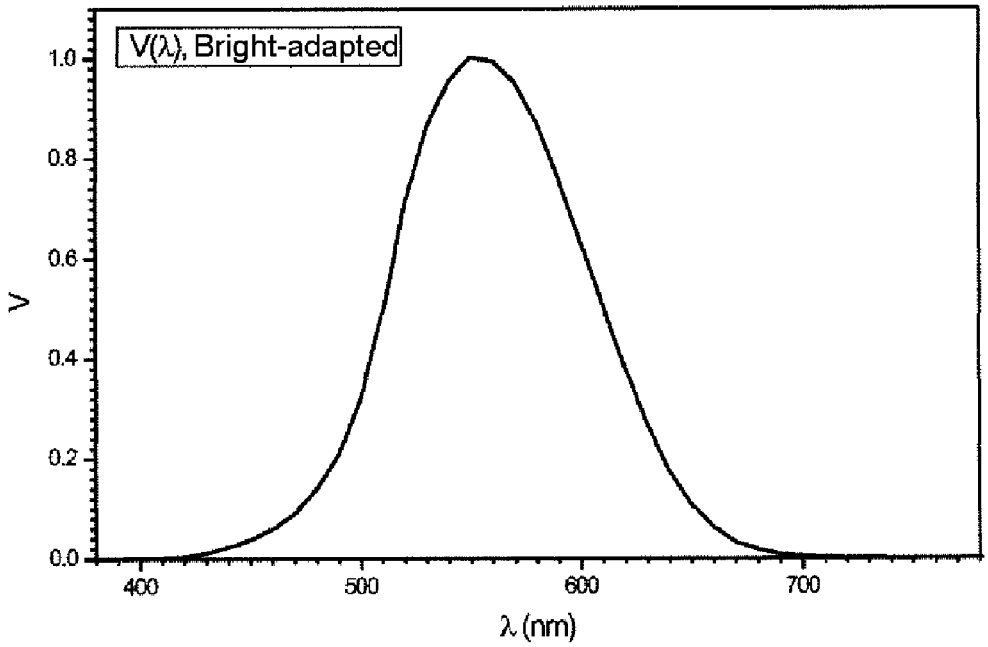
FIG. 7 shows a diagram of the spectral eye sensitivity curve.

Here, the bright-adapted sensitivity of the human eye is jointly taken into account as a weighting function, and therefore at the same time also restricts the integration to the visible spectral range. The eye's spectral sensitivity V(λ) is shown in FIG. 7.

In order to carry out the individual steps of determining $I_{h1}(\lambda)$, $I_{h2}(\lambda)$ and $I_u(\lambda)$ as presented, with the full interval width of 30 nm, measurement values above 380 nm and below 780 nm are also required at the edge of the wavelength range.

However, weighting with the eye sensitivity V(λ), which is equal to zero outside the wavelength range of from 380 nm to 780 nm, means that carrying out the measurement only between 380 nm and 780 nm is sufficient in order to determine the atomic line component AL. When determining $I_{h1}(\lambda)$, $I_{h2}(\lambda)$ and $I_u(\lambda)$, the interval size in the individual steps may then need to be restricted to the range available in the measurement values. In order to determine the values of $I_{h1}$(390 nm), $I_{h2}$(390 nm) and $I_u$(390 nm), for example, only the interval of from 380 nm to 405 nm is used instead of the interval of from 375 nm to 405 nm, corresponding to the interval width of 30 nm.

As may be seen for example in FIG. 4 at 535 nm, absorptions due to atomic lines (here, it is the Tl line at 535 nm) can make troughs occur in the continuous molecular radiation. These occur in such a narrow wavelength range that they do not affect the positive properties of the continuous molecular radiation, for example the good color rendering. However, these troughs become commensurately deeper, and actually visible in higher numbers, when the spectral resolution for measuring $I_m(\lambda)$ is greater.

If these troughs lie closer together than the interval width of 30 nm, then the background curve $I_u(\lambda)$ determined in said way will be falsely pulled downward. In order to prevent this, the spectral resolution for measuring $I_m(\lambda)$ should be restricted to the range of from 0.25 nm to 0.35 nm.

The upper limit derives from the need to select the resolution high enough so that the atomic lines can actually be resolved.

If measurement is carried out with a spectral resolution higher than 0.25 nm, then the measurement $I_m(\lambda)$ must be converted to a spectral resolution within the limits of from 0.25 nm to 0.35 nm before determining $I_{h1}(\lambda)$, $I_{h2}(\lambda)$ and $I_u(\lambda)$. This may, for example, be done by averaging over a plurality of neighboring measurement points.

Simply speaking, the atomic line component integrally describes the part of the measurement curve remaining above the background curve constructed as described above. It measures an area ratio relative to the area below the measurement curve overall.

In the present exemplary embodiments, the atomic line components are 4% for the ceramic lamps according to exemplary embodiments A1 and A2, and 12% for the quartz lamp according to exemplary embodiment A3. This shows that there is a relatively very large continuous background owing to the molecular dominance according to the invention in the emission, which greatly reduces the relative importance of the atomic line emission.

Figure 8:
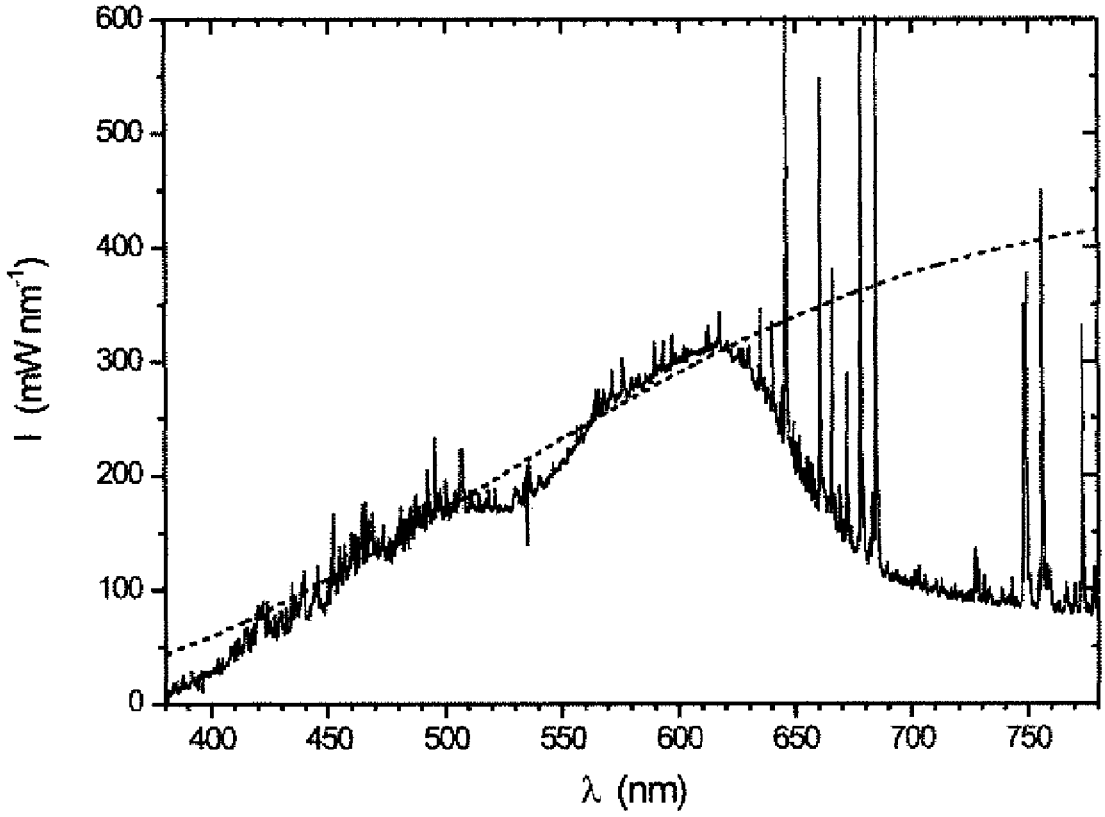
FIG. 8 shows the emission spectrum of FIG. 4 in comparison with a Planck curve.

FIG. 8 shows the measurement curve $I_m(\lambda)$ of FIG. 4 together with a superimposed Planck curve (represented by dashes) for a black-body radiator with a temperature of 3320 K.

It can be seen that the spectrum behaves in a very Planck-like fashion until the red wavelength range of about 600 nm upward. Quantitatively, this means a color difference value $\Delta C$ of $3\times10^{-4}$. The luminous efficiency was 94 lm/W with a color rendering index of Ra=92. This exemplary embodiment is therefore outstandingly suitable for general lighting.

Figure 9:
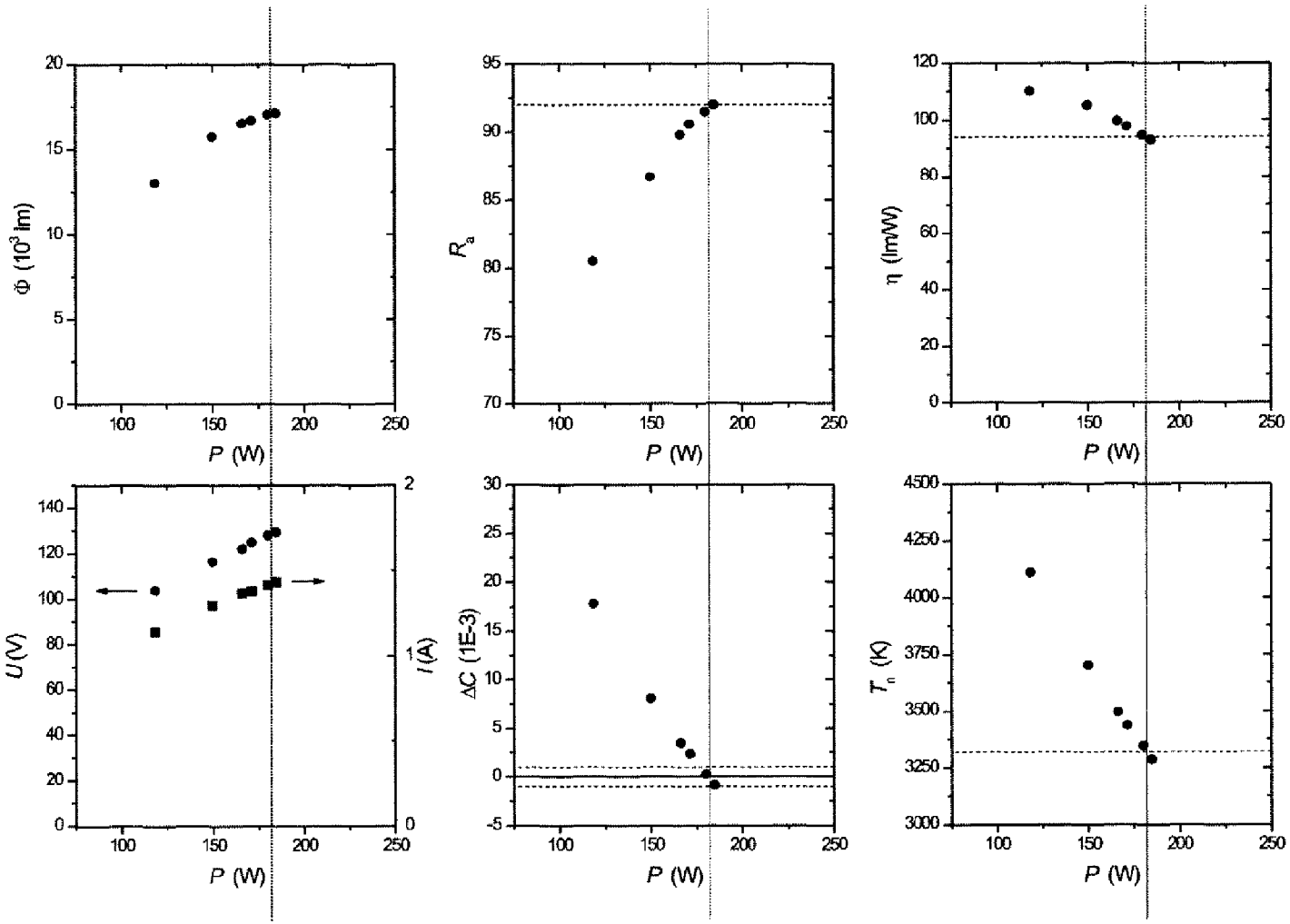
FIG. 9 shows various characteristic data of the lamp in FIG. 1 in six individual diagrams as a function of the lamp power.

In six individual diagrams, FIG. 9 shows various characteristic data of the lamp Al of FIG. 1, used as an exemplary embodiment, in each case as a function of the lamp power on the horizontal axis. From left to right, at the top there is first the luminous flux $\Phi$, the color rendering index Ra, the luminous efficiency $\eta$, and at the bottom from left to right the lamp voltage U and the lamp current I, with the points represented as squares assigned to the current axis on the right and the upper points assigned to the voltage axis on the left, the color difference $\Delta C$ and finally the most similar color temperature $T_n$, i.e. the temperature of the black-body radiator with the most similar color. It can be seen that in particular the color rendering index and the color difference are very power-dependent, and take on particularly good values at values of 180 W. The luminous efficiency is thereby degraded only little. Here, it is not recommendable to go much beyond 180 W. It can thus be seen that with the invention, above all with relatively high powers in relation to the discharge vessel size, it is possible to produce high-pressure discharge lamps with unusually good color rendering properties.

Supplementarily, regarding the "color difference $\Delta C$" reference is made to CIE Technical Report 13.3 (1995). This involves evaluating the quality of the light color of a lamp in respect of a sensory perception interpreted as "natural" by humans. The color difference is a measure of the closeness of the lamp spectrum to the Planckian radiation behavior up to a color temperature of 5000 K, or to daylight spectra above this limit. There are fields of application in which large values of the color difference are not problematic, although for more demanding lighting tasks, for example in general lighting, the lamp according to the invention should preferably have a color difference value with a magnitude of less than $10^{-2}$, more preferably less than $5\times10^{-3}$ and even more preferably less than $2\times10^{-3}$.

The constituents referred to in the exemplary embodiment may be replaced by alternatives in the scope of the teaching of this invention; for example, Xe may also very well be replaced fully or partially by Ar or Kr, or a noble gas mixture. $AlI_3$ may for example be replaced by $InI_3$, InI or $MgI_2$, again fully or partially. The rare earth halide $TmI_3$ may also be replaced, in particular by $CeI_3$ or by other rare earth iodides or rare earth bromides or rare earth mixtures.

The ability to avoid components such as Hg constitutes an advantage of the invention. The lamp may however also contain some of them. The aforementioned pronounced radiation contributions of Na, K and Ca should be avoided, preferably fully or at least to such an extent that the described criterion for dominance of the molecular radiation remains fulfilled.

The exemplary embodiment contains a small amount of thallium iodide TlI. Owing to its resonance line at 535 nm, Tl is conventionally used to increase efficiency. FIGS. 4 to 6 shows that this does not make any substantial contribution to the emission. Here, the function of TlI merely consists in arc transfer and additional arc stabilization. This constituent should be used with caution since Tl also has lines in the infrared range, where it acts in a similar way to Na, K or Ca.

The conditions in the lamp should thus be configured so that the atomic line emission does not play an essential role in as large as possible a spectral range of the continuum in the visible range, i.e. the plasma is essentially optically thick in this wavelength range for this radiation, or this radiation is generated to a small extent. At the same time the molecular emission of rare earth halides, in particular monohalides, from the plasma should be a maximally promoted, in particular by minimizing the cooling due to emission in the spectral range in which the plasma is no longer optically thick enough. In the present exemplary embodiment, this spectral range extends from 380 nm to about 600 nm, and is therefore relatively large. Such large ranges are not however compulsory.

Figure 10:
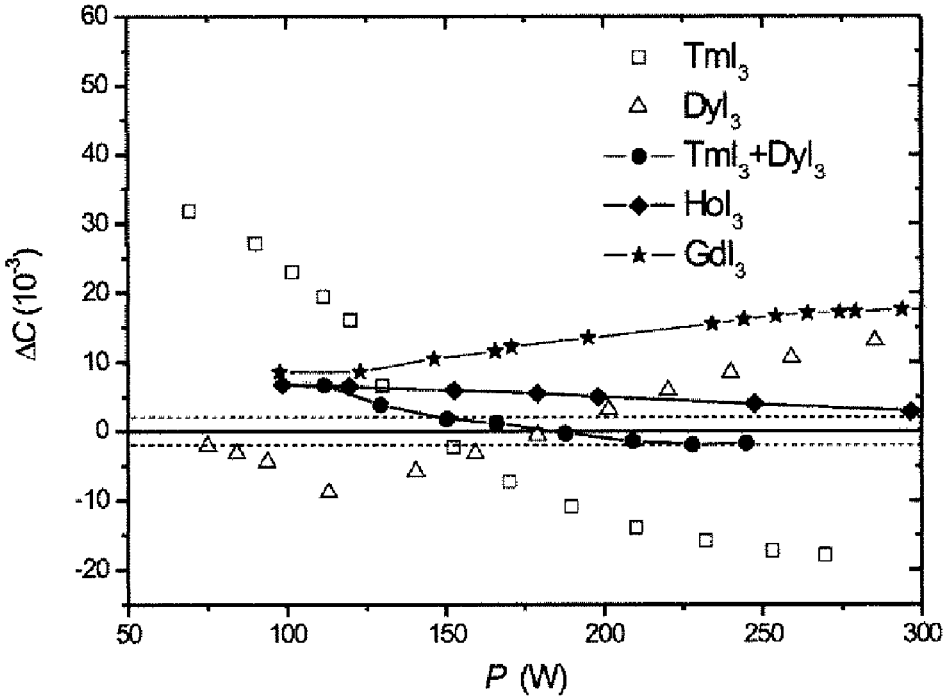
FIGS. 10-11 show the color deviation and color temperature as a function of the power of the lamp for different fillings.
Figure 18:
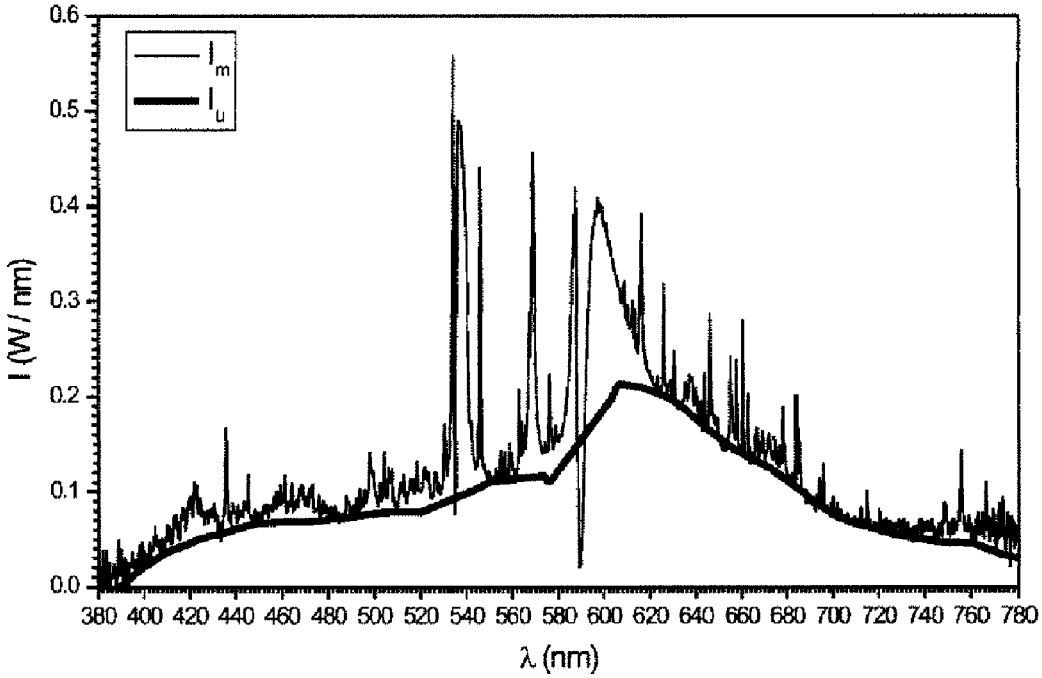
FIG 18 (Prior Art)
FIGS. 18-19 shows the emission spectrum for two lamps according to the prior art.

Commercial lamps exhibit line components of much more than 20%. FIG. 18 shows an example. This is a lamp with a ceramic discharge vessel of the type HCI-TS WDL 150 W (manufacturer OSRAM), which was spectrally analyzed in an Ulbricht sphere after 10 hours of burning time. An AL value of 35% is found for the atomic line component. FIG. 10 shows the constructed curve for the background, as described above.

Figure 19:
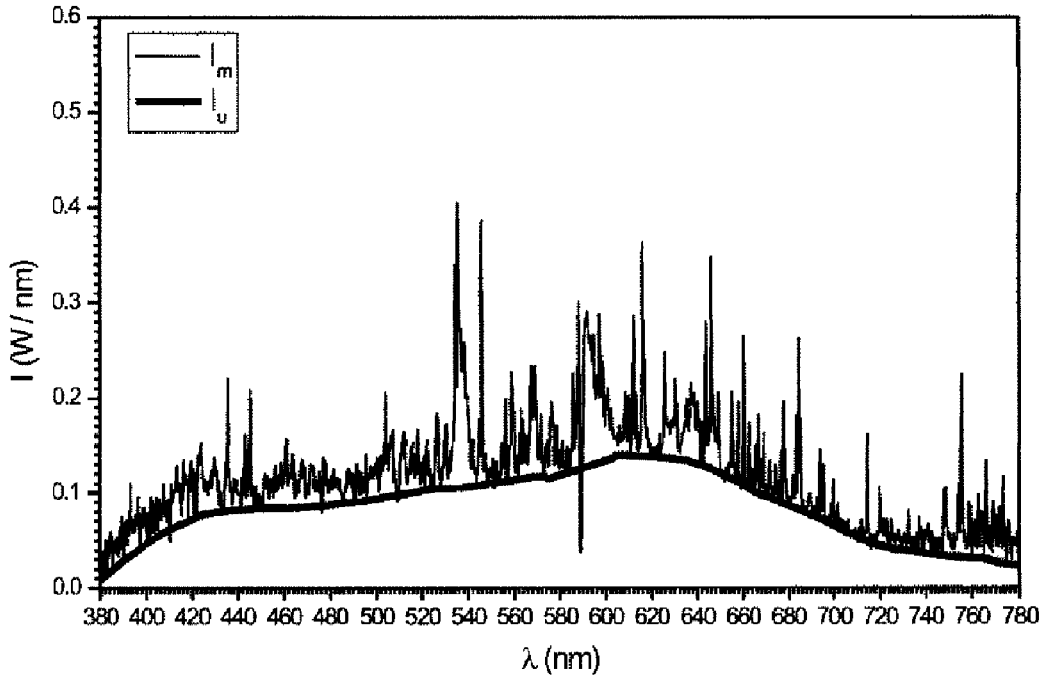
FIG 19 (Prior Art)

Another high-pressure discharge lamp with a ceramic discharge vessel of the type CMD-TD 942 150 W (manufacturer Philips) with a spectral distribution according to FIG. 19 exhibits an AL value of 37%.

The production of a molecular radiation-dominated, preferably Hg-free high-pressure discharge lamp, which is distinguished by good efficiency and color rendering over a large power range, will be described below in a particularly preferred embodiment.

Figure 11:
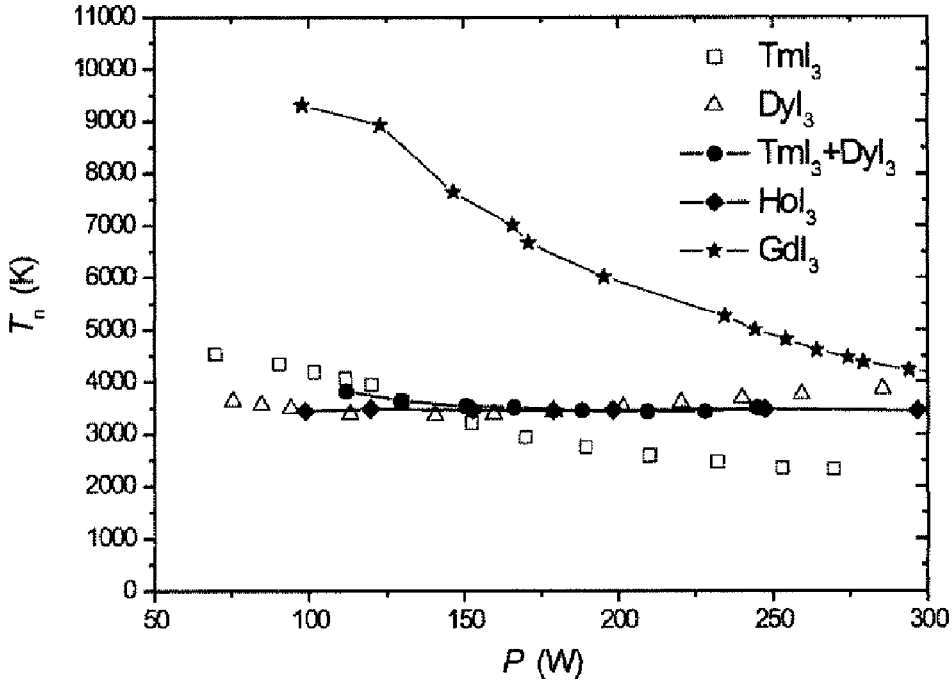
Figure 12:
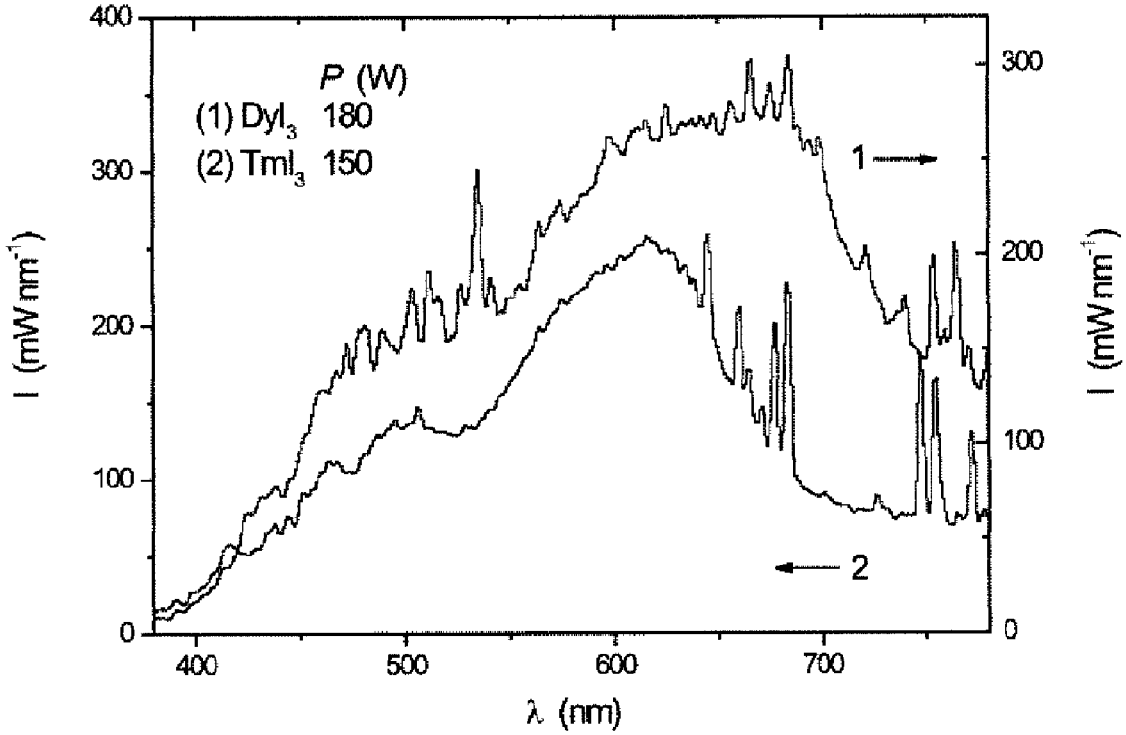
FIG. 12 shows the emission spectrum of two fillings.

So far, it has been shown that a relatively sensitive power dependency of the color distance $\Delta C$ must be tolerated when merely using for example $TmI_3$ as a molecular radiator. Minor differences in the power from the working point with $\Delta C=0$ lead to sizable $\Delta C$ values, which change very rapidly with an increasing power from positive to negative values. A similar behavior is also encountered when using other rare earths. The use of for example $DyI_3$, on the other hand, leads to a $\Delta C(P)$ characteristic curve in which $\Delta C$ changes locally from negative values to positive values with an increasing power—which is the opposite to the characteristic curve of $TmI_3$. A similar dependency is found for the color temperatures $T_n(P)$. Spectra of lamps respectively containing $TmI_3$ or $DyI_3$ in the vicinity of the so-called working point ($\Delta C<2E-3$) are represented by way of example in FIG. 12. FIGS. 10 and 11 show the characteristic curves for $\Delta C$ and $T_n$. The region of the working point is indicated by dashes.

Figure 13:
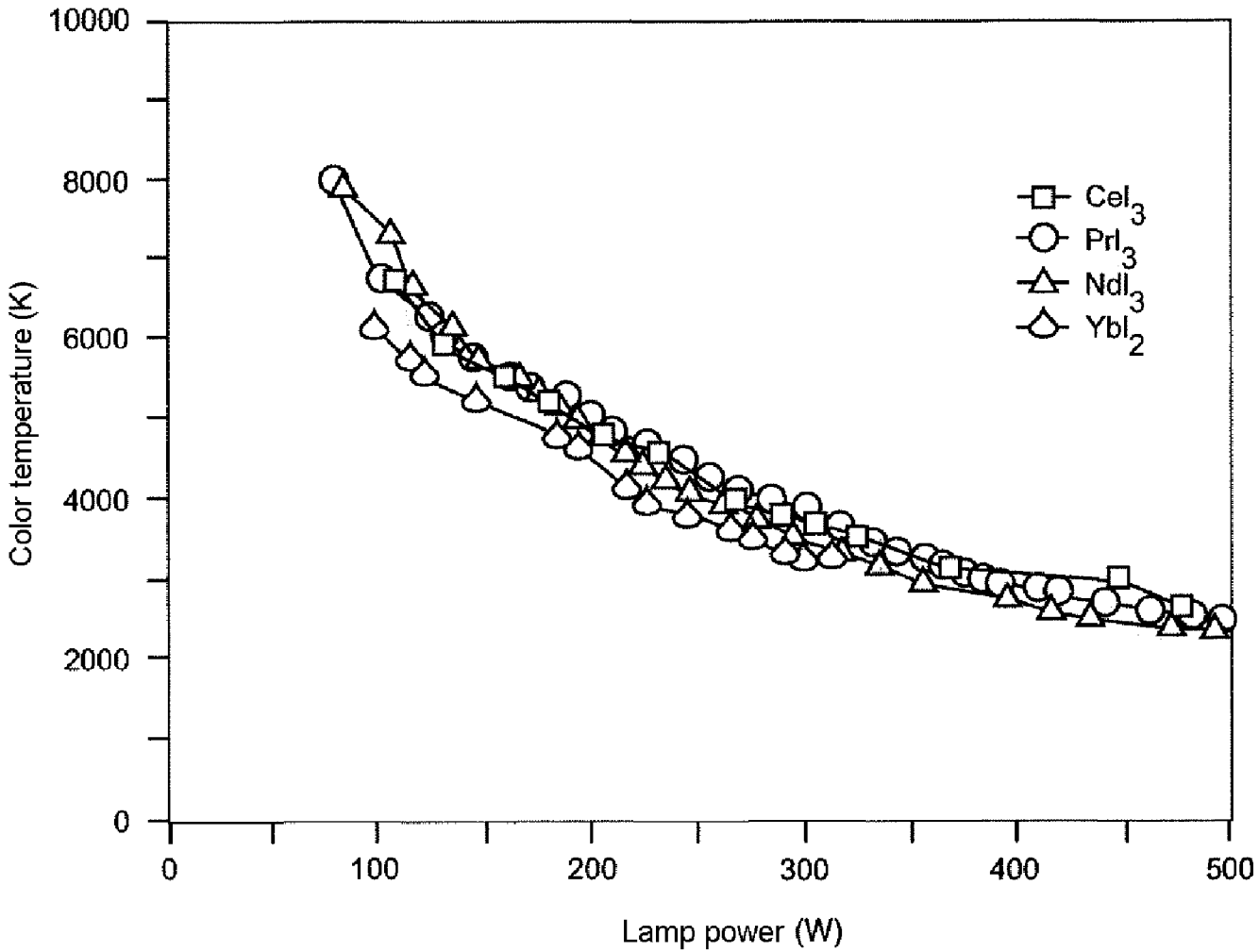
FIGS. 13-16 show the color deviation and color temperature as a function of the power of the lamp for a range of rare earths.
Figure 14:
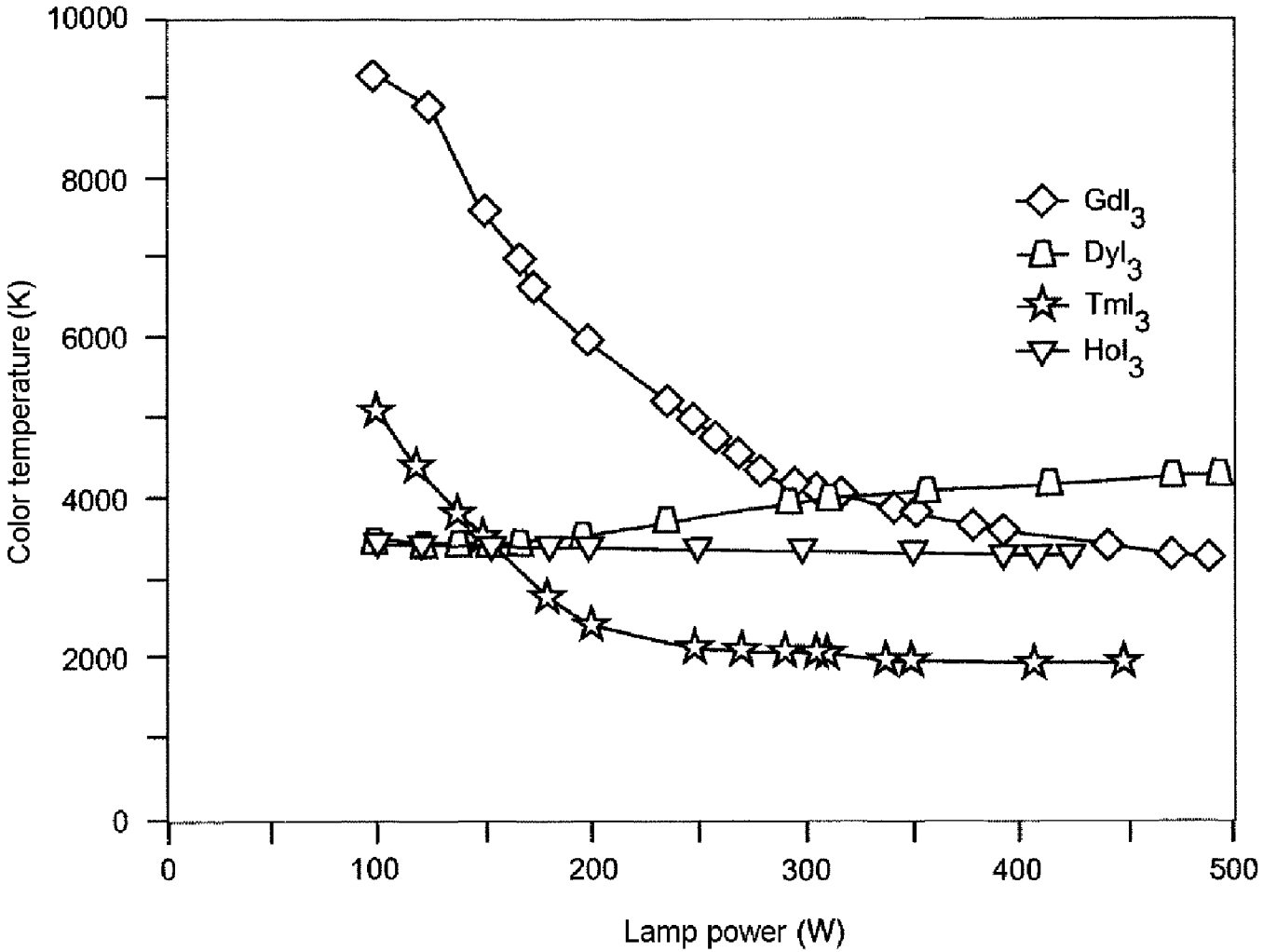
Figure 15:
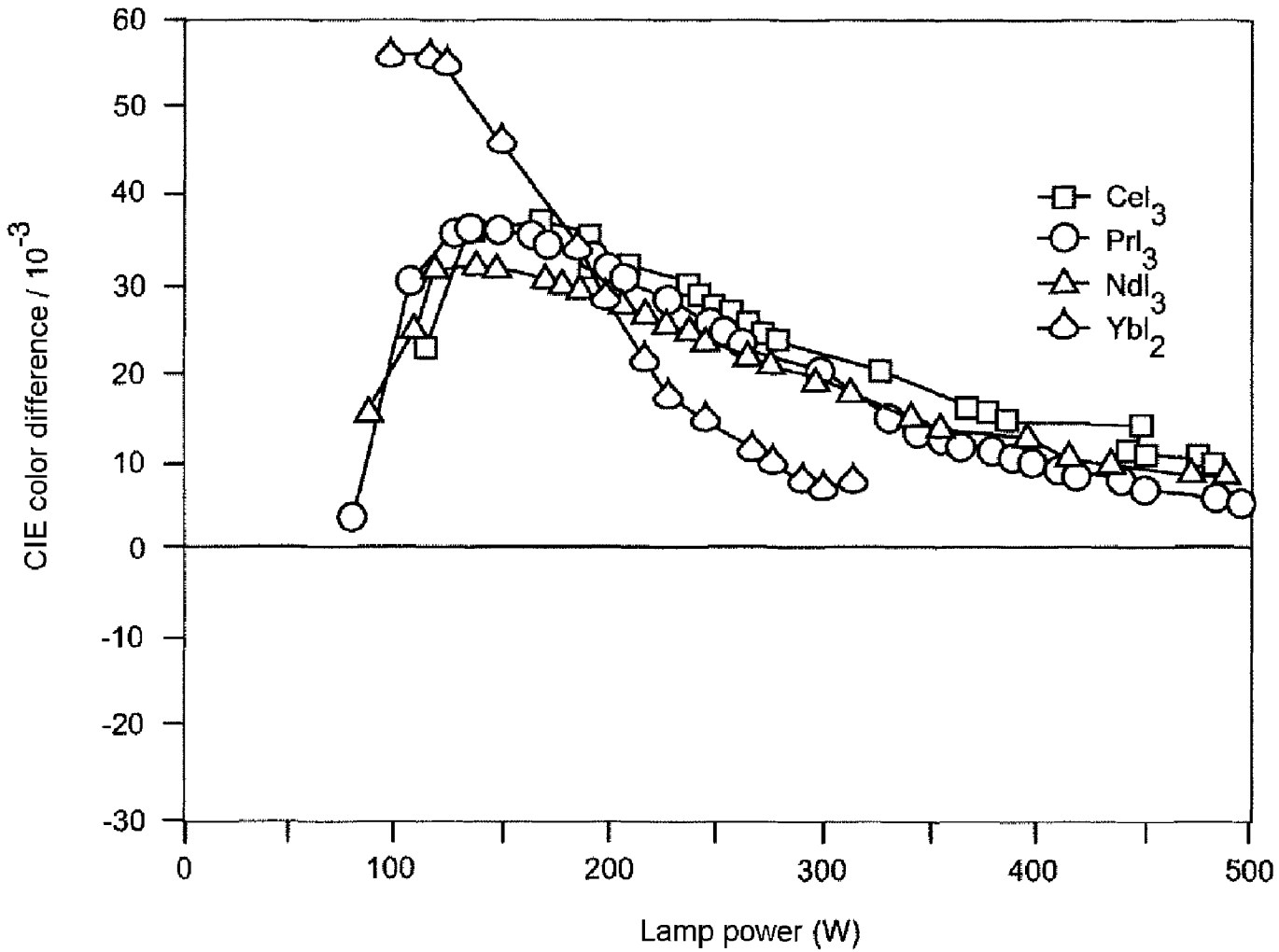
Figure 16:
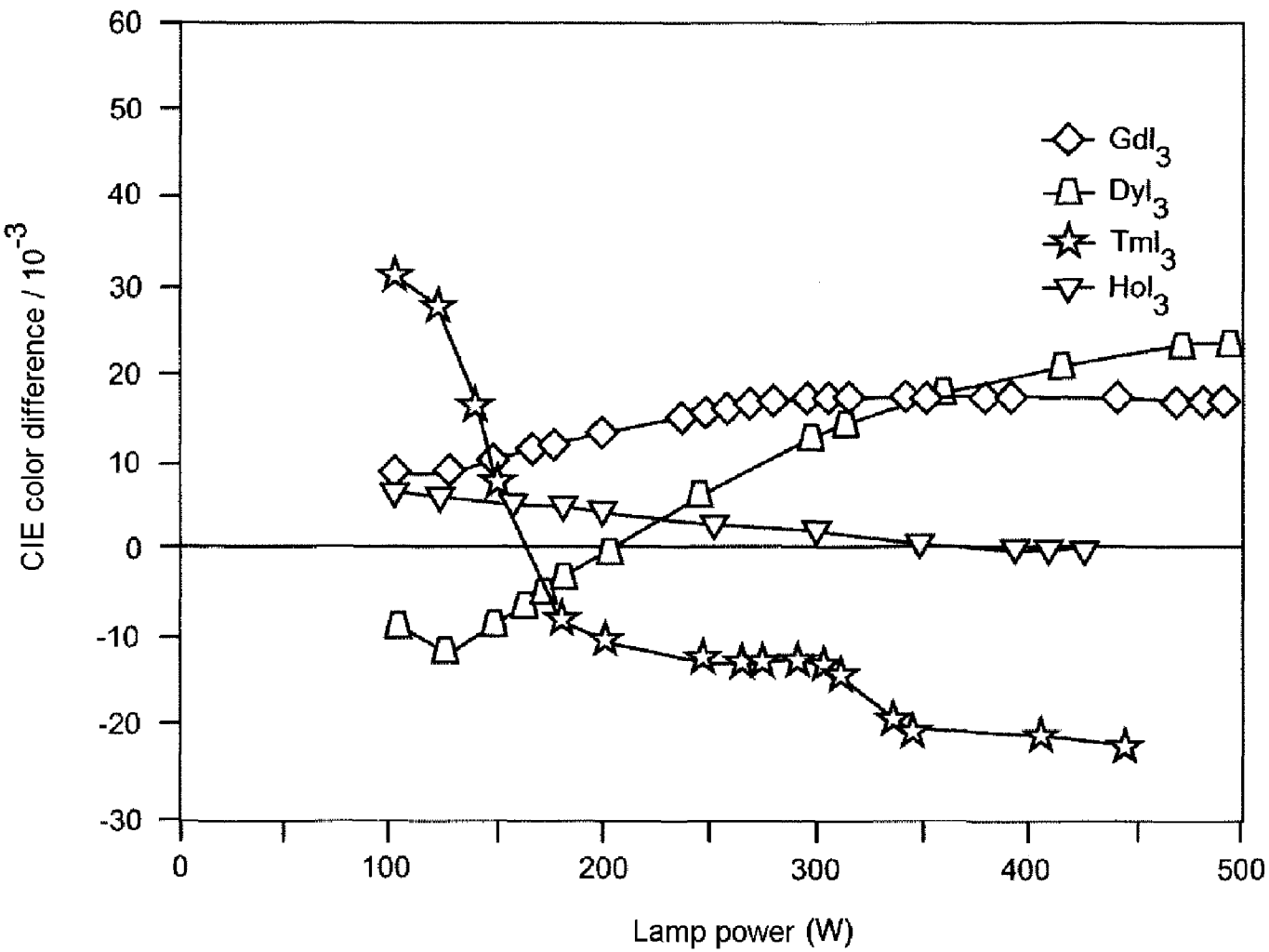

Other exemplary embodiments are shown in FIGS. 13 to 16. Each of these is a high-pressure discharge lamp with a ceramic discharge vessel, based on filling with 1 bar of Xe, 2 mg of $AlI_3$, 0.5 mg of TlI and a halide of a rare earth metal. The behaviors of the rare earth metals $CeI_3$, $PrI_3$, $NdI_3$, $GdI_3$, $DyI_3$, $TmI_3$, $YbI_2$ and $HoI_3$ are shown. FIG. 16 illustrates that above all Tm and Ho are suitable as members of a first group, for which the color difference $\Delta C$ decreases with an increasing power, because they locally reach values of $\Delta C$ close to zero and/or locally have a flat slope. Other members of this group are shown in FIG. 15. These are in particular Pr, Ce and Nd, as well as Yb. Above all Dy and Gd are suitable as members of a second group, for which the color difference $\Delta C$ increases with an increasing power, see FIG. 16. The associated color temperature (in kelvin) is shown in FIGS. 13 and 14.

Specific exemplary embodiments, which relate to $HoI_3$ and also $GdI_3$, are explained in FIGS. 10 and 11. The high-pressure discharge lamp with a ceramic discharge vessel is represented based on filling with 1 bar of Xe, 2 mg of $AlI_3$, 0.5 mg of TlI and 4 mg of $HoI_3$ (example shown by rhombi) and based on filling with 1 bar of Xe, 2 mg of $AlI_3$, 0.5 mg of TlI and 4 mg of $GdI_3$ (example shown by stars). Respectively shown are $\Delta C(P)$ close to zero ($\Delta C$ in units of $10^{-3}$), see FIG. 10, and the color temperature $T_n$ (in K), see FIG. 11. The two values are presented as a function of the power (P) in the range of from 50 to 300 W. Both iodides exhibit a flat profile of the color distance ΔC(P) in the event of a power variation. When using $HoI_3$ on its own, the color temperature is particularly constant as a function of the power variation.

A suitable combination of $TmI_3$ and $DyI_3$ is particularly preferred, because it allows the power dependency of ΔC and $T_n$ to be adjusted deliberately with a particularly high efficiency. A suitable combination is advantageously a mixture which contains from 25 to 75 mol % $TmI_3$, the remainder being $DyI_3$. A $TmI_3$ proportion of from 45 to 55 mol % is particularly preferred. A specific example with a 1:1 mixture is represented in FIG. 10 for the color difference ΔC and in FIG. 11 for the change in the color temperature. Good results are furthermore provided by an exemplary embodiment in which $TmI_3$ and $HoI_3$ are used together with $DyI_3$.

Figure 17:
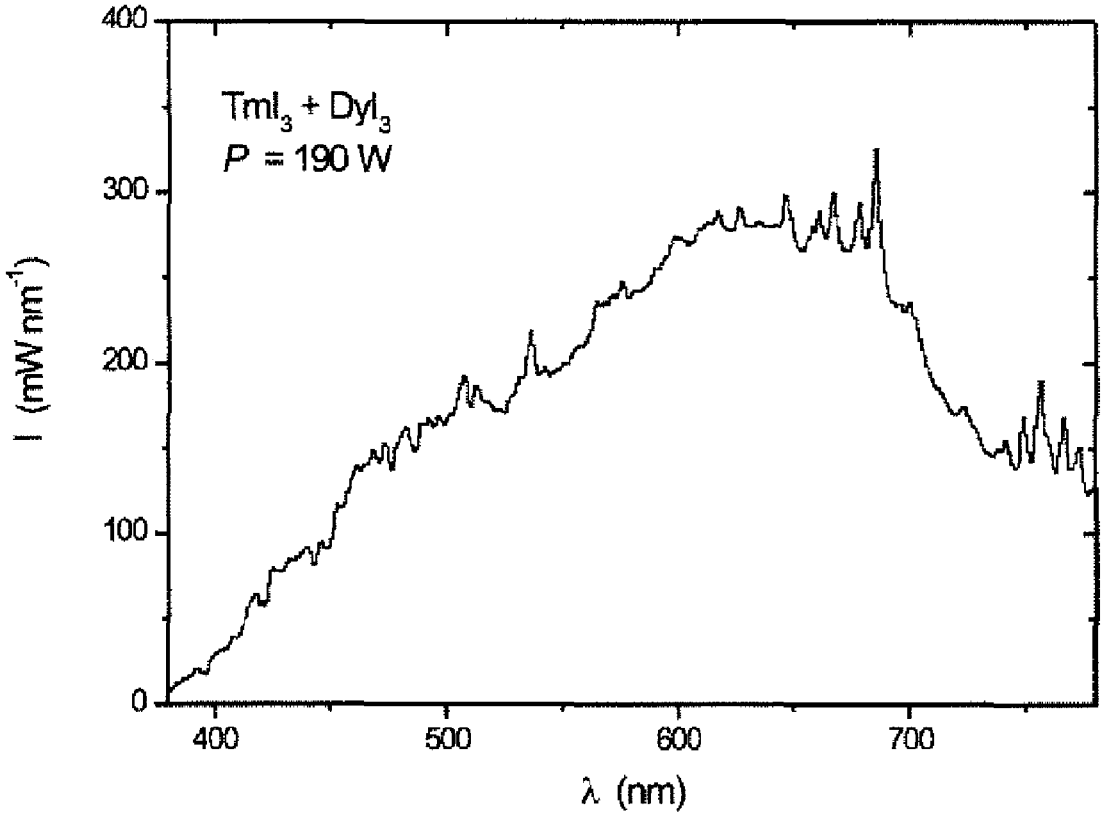
FIG. 17 shows the emission spectrum of a high-pressure discharge lamp with a Tm/Dy mixture.

A suitable combination of these two groups of molecular radiators leads to spectra which are characterized by a particularly flat profile of ΔC(P) close to zero (ΔC<2E-3), as may be seen in FIGS. 15 and 16. An efficiency of more than 80 lm/W, color rendering Ra>=95, good red rendering with R9=74-95 and a color temperature $T_n$ of about 3500 K can be achieved over a power variation of almost 1:2, see FIGS. 13 to 14. FIG. 17 shows the emission spectrum of a high-pressure discharge lamp with a Tm/Dy mixture, as specifically described in FIGS. 10 and 11.

The most important parameters for the cylindrical discharge vessel used for the exemplary embodiment (see FIG. 1) are the internal diameter (d=9.1 mm), the internal length (l=13 mm) and the electrode spacing (a=10 mm).

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

All the fillings of the lamps contained 1 bar of Xe (cold fill pressure), 2 mg of $AlI_3$ and 0.5 mg of TlI. The lamps were also provided with 4 mg of $TmI_3$, 4 mg $DyI_3$ or 2 mg of $TmI_3$+2 mg of $DyI_3$ as dominant molecular radiators. Instead of $DyI_3$, or in addition to $DyI_3$, $GdI_3$ may preferably be used.

The invention claimed is:

1. A high-pressure discharge lamp, comprising:
a discharge vessel, which contains:
electrodes,
at least one noble gas as a start gas,
at least one element selected from the group consisting of Al, In, Mg, Tl, Hg, and Zn for arc transfer and discharge vessel wall heating, and
at least one rare earth halide for the generation of radiation, which is configured such that a generated light is dominated by molecular radiation, wherein at least one member of a first group of rare earth halides is used together with at least one member of a second group of rare earth halides, the first group having the property that its color distance decreases with a power increase when the power of the lamp is increased in a predetermined power interval, and the second group having the property that its color distance increases with a power increase when the power of the lamp is increased in this predetermined power interval.

2. The high-pressure discharge lamp as claimed in claim 1, wherein the noble gas is at least one noble gas selected from the group consisting of Xe, Ar, and Kr.

3. The high-pressure discharge lamp as claimed in claim 2, wherein the cold fill partial pressure of the noble gas is between 500 mbar and 5 bar.

4. The high-pressure discharge lamp as claimed in claim 1, wherein the at least one element is selected from the group consisting of Al, In, and Mg as the arc transfer and discharge vessel wall heating element.

5. The high-pressure discharge lamp as claimed in claim 1, wherein the first rare earth halide contains at least one element selected from the group consisting of Tm, Ho, Ce, Pr, and Nd.

6. The high-pressure discharge lamp as claimed in claim 1, wherein the second rare earth halide contains at least one element selected from the group consisting of Dy and Gd.

7. The high-pressure discharge lamp as claimed in claim 1, wherein the discharge vessel contains no amount of Na relevant for emission properties.

8. The high-pressure discharge lamp as claimed in claim 1, wherein the discharge vessel contains no amount of $CaI_2$ or K relevant for emission properties.

9. The high-pressure discharge lamp as claimed in claim 1, wherein the discharge vessel comprises ceramic and the following applies for the color distance ΔC: $|\Delta C|<10^{-2}$.

10. The high-pressure discharge lamp as claimed in claim 1, wherein the following applies for the lamp's luminous efficiency η: η>90 lm/W.

11. The high-pressure discharge lamp as claimed in claim 1, wherein the following applies for the lamp's color rendering index Ra: Ra≧90.

12. The high-pressure discharge lamp as claimed in claim 4, wherein it is filled with at least one of the arc transfer and discharge vessel wall heating element and the rare earth element in the form of an iodide or bromide.

13. The high-pressure discharge lamp as claimed in claim 1, wherein the following applies for the lamp's atomic line component AL: AL≦40%,
where:

$$AL = \frac{\int_0^\infty V(\lambda) I_m(\lambda)\, d\lambda - \int_0^\infty V(\lambda) I_u(\lambda)\, d\lambda}{\int_0^\infty V(\lambda) I_m(\lambda)\, d\lambda}$$

in which:
$V(\lambda)$ is the bright-adapted eye sensitivity of the human eye,
$I_m(\lambda)$ is the spectral intensity distribution of the high-pressure discharge lamp,
measured by a measurement in an Ulbricht sphere with a resolution of between 0.35 nm and 0.25 nm inclusive, or, with a higher measurement resolution, converted to a resolution in this range by averaging, and
$I_u(\lambda)$ is a model function approximating the continuous background of the
measured intensity profile $I_m(\lambda)$, which is determined by
1. determining a function $I_{h1}(\lambda)$ with the minima of $I_m(\lambda)$ existing in width intervals of 30 nm around the respective wavelength value,
2. determining another function $I_{h2}(\lambda)$ with the maxima of $I_{h1}(\lambda)$ existing in width intervals of 30 nm around the respective wavelength value, 3. determining the function $I_u(\lambda)$ with the maxima of $I_{h2}(\lambda)$ existing in width intervals of 30 nm around the respective wavelength value.

14. The high-pressure discharge lamp as claimed in claim 13, wherein the discharge vessel comprises ceramic and the following applies for AL: AL<20%.

15. The high-pressure discharge lamp as claimed in claim 13, wherein the discharge vessel comprises quartz glass and the following applies for AL: AL≦30%.

16. A lighting system, comprising:

a high-pressure discharge lamp, comprising a discharge vessel, which contains:

electrodes, at least one noble gas as a start gas, at least one element selected from the group consisting of Al, In, Mg, Tl, Hg, and Zn for arc transfer and discharge vessel wall heating, and at least one rare earth halide for the generation of radiation, which is configured such that a generated light is dominated by molecular radiation, wherein at least one member of a first group of rare earth halides is used together with at least one member of a second group of rare earth halides, the first group having the property that its color distance decreases with a power increase when the power of the lamp is increased in a predetermined power interval, and the second group having the property that its color distance increases with a power increase when the power of the lamp is increased in this predetermined power interval; and an electronic ballast device for operating the high-pressure discharge lamp.

* * * * *